US006621455B2

(12) United States Patent
Wang et al.

(10) Patent No.: US 6,621,455 B2
(45) Date of Patent: Sep. 16, 2003

(54) MULTIBAND ANTENNA

(75) Inventors: Hanyang Wang, Witney (GB); Su Quing Zhang, Oxford (GB)

(73) Assignee: Nokia Corp., Espoo (FI)

( * ) Notice: Subject to any disclaimer, the term of this patent is extended or adjusted under 35 U.S.C. 154(b) by 0 days.

(21) Appl. No.: 10/020,197

(22) Filed: Dec. 18, 2001

(65) Prior Publication Data

US 2003/0112198 A1 Jun. 19, 2003

(51) Int. Cl.[7] ..... H01Q 1/38
(52) U.S. Cl. ..... 343/700 MS; 343/702
(58) Field of Search ..... 343/702, 767, 343/700 MS, 770, 768; H01Q 1/38

(56) References Cited

U.S. PATENT DOCUMENTS 6,043,785 A * 3/2000 Marino ..... 343/767
6,292,153 B1 * 9/2001 Aiello et al. ..... 343/767
6,404,394 B1 * 6/2002 Hill ..... 343/702
6,445,906 B1 * 9/2002 Nguyen ..... 455/73

FOREIGN PATENT DOCUMENTS

| | | |
|---|---|---|
| EP | 1 018 779 A2 | 7/2000 |
| EP | 1 122 815 A2 | 8/2001 |
| EP | 1 187 255 A2 | 3/2002 |
| EP | 1 225 655 A1 | 7/2002 |
| WO | WO 98/49743 | 11/1998 |
| WO | WO 00/36700 | 6/2000 |

* cited by examiner

*Primary Examiner*—Hoanganh Le
(74) *Attorney, Agent, or Firm*—Antonelli, Terry, Stout, & Kraus, LLP

(57) ABSTRACT

An antenna has at least one slotted planar element. The slot in the planar element is open at one end and configured such that the planar element has a quarter wave resonance mode at a first frequency and there is a second resonant frequency at which the element has a ¾ wave resonance mode and/or the element's slot has a quarter wave resonance mode. The second frequency is not substantially three time the first frequency. Multiple slotted elements may be employed to achieve increased bandwidth.

44 Claims, 5 Drawing Sheets

MULTIBAND ANTENNA

FIELD OF THE INVENTION

The present invention relates to a multiband antenna.

BACKGROUND TO THE INVENTION

In recent years there has been a move towards harmonizing mobile phone systems throughout the world. For Instance, many countries have GSM900 systems enabling users from one country to use their mobile phones in another country. However, this harmonization has not yet been completed. For instance, spectrum availability has lead to the introduction of DCS1800 which is similar to GSM900 but operates in a band In the region of 1800 MHz rather than 900 MHz as in the case of GSM. Additionally, national spectrum management authorities do not necessarily decide to allocate the same bands to the public land mobile network service. For instance, in the United States of America a DCS1SOO-like system (DCS1900) is implemented in a band in the region of 1900 MHz. Further Incompatibilities arise during transitional periods when a new system is being introduced and an old one phased out.

SUMMARY OF THE INVENTION

The present invention provides a multiband antenna that is compact.

According to the present invention, there is provided a multiband antenna comprising a doubly resonant slotted substantially planar element having an open-ended slot therein, wherein said element is slotted such that said element has a quarter wave resonance mode at a first frequency and the element has a ¾ wave resonance mode at a second frequency or the slot has a quarter wave resonance mode at a second frequency, the second frequency not being substantially three time the first frequency. The planar element need not be flat but will have a large area to thickness ratio. For instance, the planar element may be curved to conform to an overriding structural limitation. Furthermore, the planar element may have small auxiliary portions, such as supporting and/or structures Greater bandwidth may be obtained by including a further doubly resonant, slotted planar element having an open-ended slot therein.

Preferably, said further element is slotted such that said further element has a quarter wave resonance mode at a third frequency and the further element has ¾ wave resonance mode at a fourth frequency or its slot has a quarter wave resonance mode at a fourth frequency, the fourth frequency not being substantially three time the third frequency, More preferably, the first and third frequencies are sufficiently close to provide a single unbroken usable bandwidth and/or the second and fourth frequencies are sufficiently close to provide a single unbroken usable bandwidth. This gives a broader bandwidth.

Preferably, a feed circuit comprising an elongate signal line extends past the open ends of the or each slot.

Preferably, said planar elements are separated by a non-conductive strip into which said slots open.

Preferably, an antenna according to the present invention includes an insulating substrate, and the or each planar element is on one side of said substrate and said signal line comprises a strip on the other side of the substrate and is aligned with said non-conductive strip.

Preferably, there is a ground connection to the or each slotted planar element.

DETAILED DESCRIPTION OF THE PREFERRED EMBODIMENT

Embodiments of the present invention will now be described, by way of example, with reference to the accompanying drawings.

Figure 1:
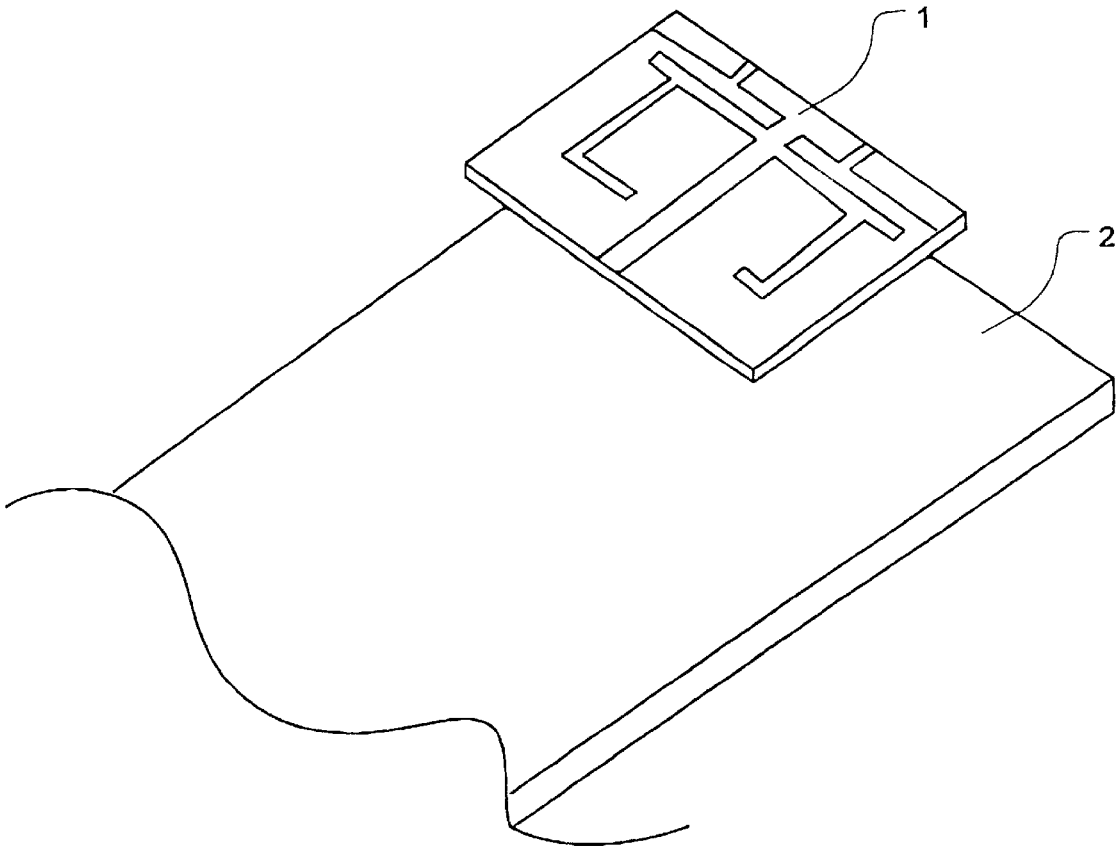
FIG. 1 is a perspective view of an antenna according to the present invention.

Referring to FIG. 1, an antenna 1 according to the present invention is mounted to the main printed circuit board (PCB) 2 of a radio communication device. The antenna 1 lies parallel to and is spaced perpendicularly from a major face of the main printed circuit board 2.

Figure 2:
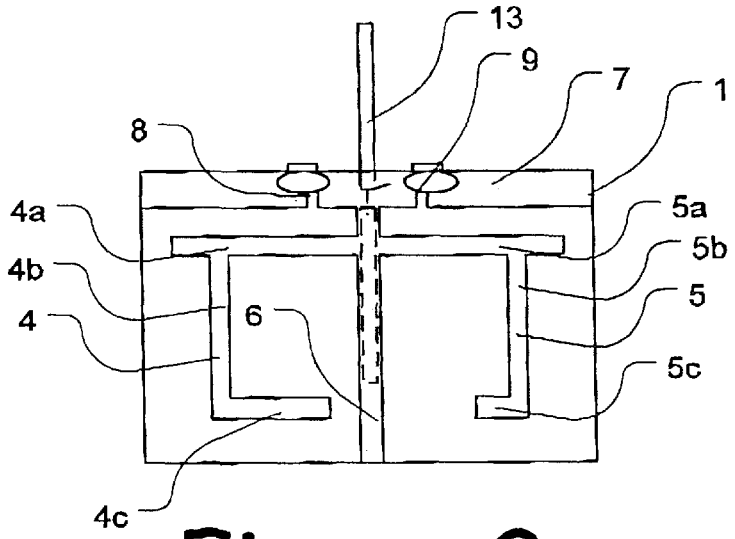
FIG. 2 is a top plan view of the antenna of FIG. 1.
Figure 3:
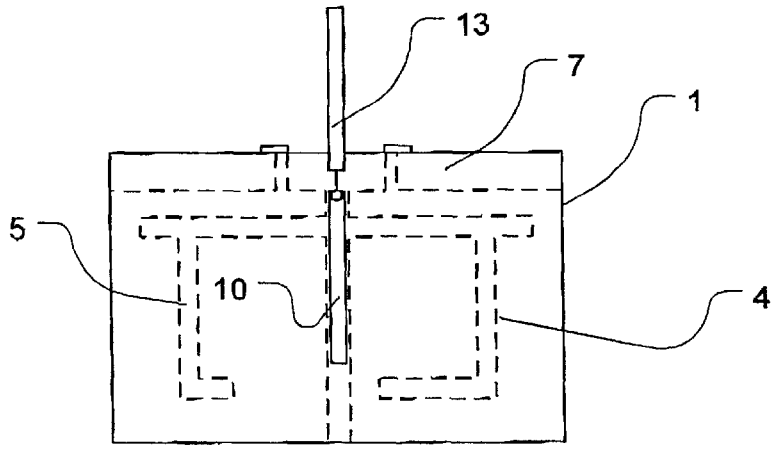
FIG. 3 is a bottom plan view of the antenna of FIG. 1.

Referring to FIGS. 2 and 3, the antenna 1 comprises a substrate 3. First and second angular, substantially C-shaped, slots 4, 5 are on one side of the substrate 3. The slots 4, 5 extend in opposite directions from a central strip 6, extending across the printed circuit board 3. Both the central strip and the slots 4, 5 comprise regions from which copper of a conductive layer on the substrate 3 has been removed. The copper conductor has also been removed from a margin 7 of the printed circuit board 3 which runs perpendicular to the central strip 6, except for two branches 8, 9 reaching to the edge of the substrate 3 on respective sides of the central strip 6.

The antenna's feed is provided on the other side of the substrate 3 and comprises a conductive strip 10 aligned with the central strip 6. The conductive strip 10 starts at the edge of the aforementioned margin 7.

The first slot 4 comprises a first section 4*a* extending parallel to the aforementioned margin 7, a second section 4*b* extending from a point, about two thirds of the way along the first section 4*a*, parallel to the central strip 6 and a third portion 4*c* extending towards the central strip 6 from the distal end of the second section 4*b* and at a right angle thereto. The first section 4*a* is 12 mm long, the second section 4*b* is 17 mm long from the edge of the first section 4*a* and the third section 4*c* is 8 mm long including the width of the second section 4*b*.

The second slot 5 comprises first, second and third sections 5*a*, 5*b*, 5*c* arranged as a mirror image of the first slot element 4 except that the third section is shorter, being only 1 mm long.

The sections 4*a*, 4*b*, 4*c*, 5*a*, 5*b*, 5*c* of the slot elements 4, 5 are all 2.5 mm wide.

The branches 8, 9 are 1 mm wide. The conductive strip 10 is 1.5 mm wide and 15.5 mm long and the central strip 6 is slightly wider. The substrate 3 is 1.5 mm thick and comprises LCP with a relative permittivity of 3.8.

Figure 4:
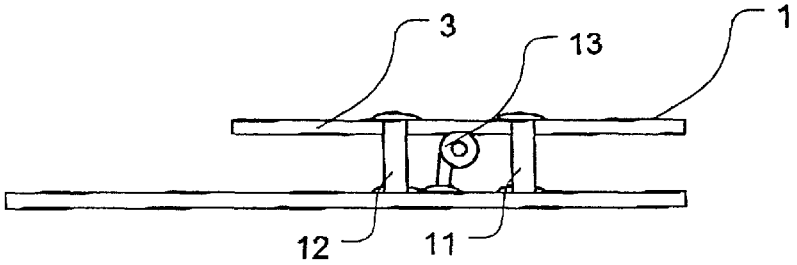
FIG. 4 is an end view of the antenna of FIG. 1.

Referring additionally to FIG. 4, first and second copper strips 11, 12 are soldered to respective branches 8, 9 at one end and to the ground plane of the main circuit board 2 at the other end. The core of a coaxial cable 13 is soldered to the end of the conductive strip 10, adjacent the aforementioned margin 7. The shield of the coaxial cable 13 is soldered to the ground plane of the main circuit board 2. The coaxial cable 13 connects the antenna to transmitter and receiver circuitry (not shown).

Figure 5:
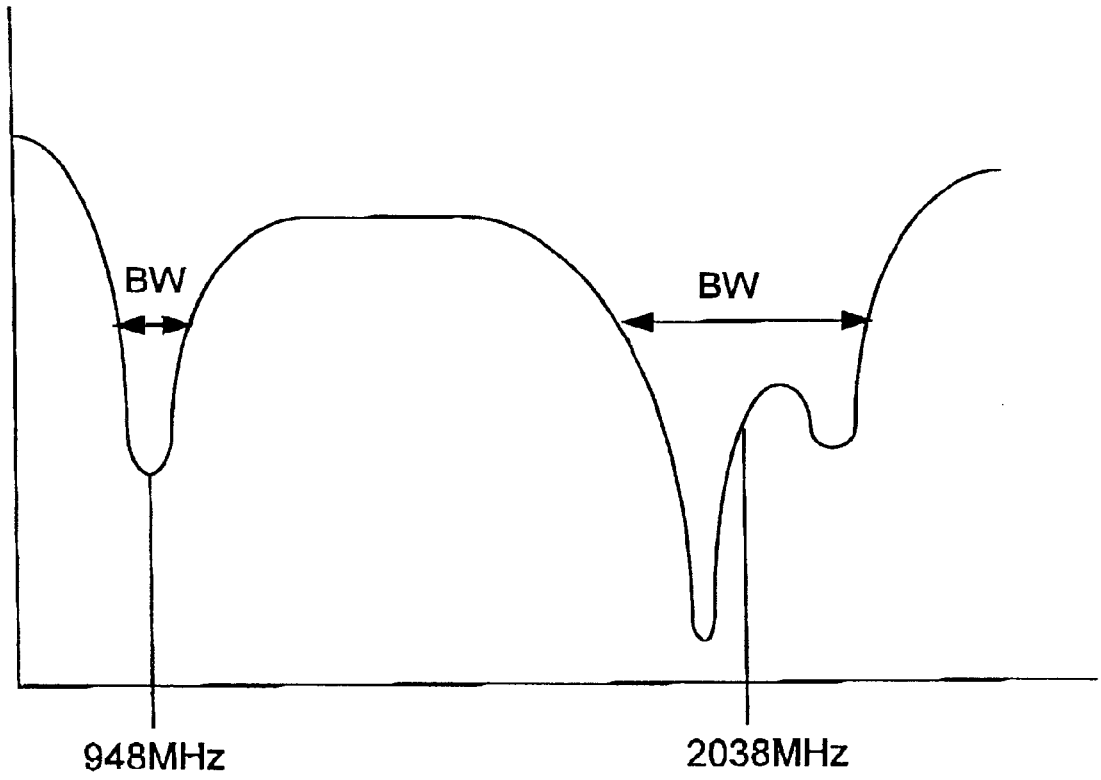
FIG. 5 illustrates the return loss characteristic of the antenna of FIG. 1.
Figure 6A:
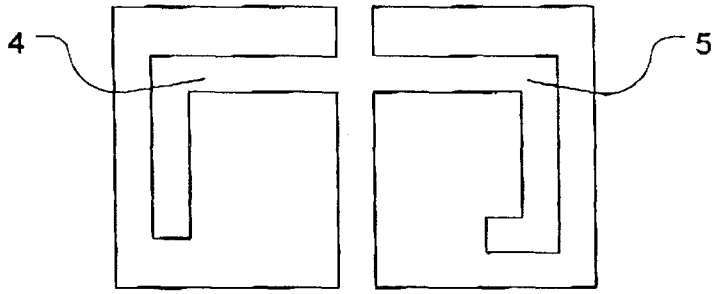
FIGS. 6(*a*) to 6(*f*) illustrate alternative embodiments.
Figure 6B:
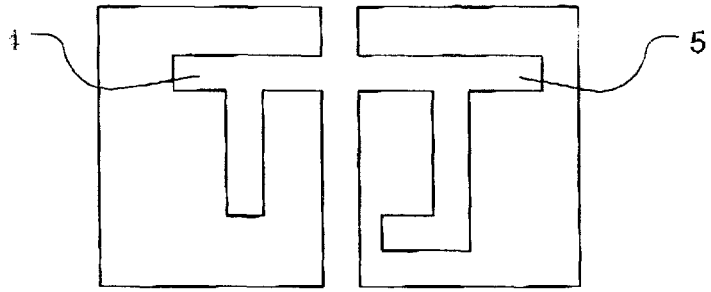
Figure 6C:
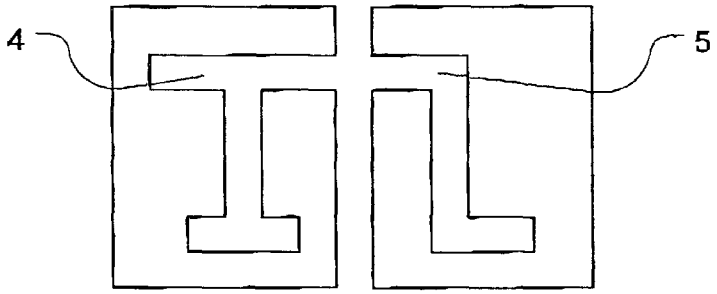
Figure 6D:
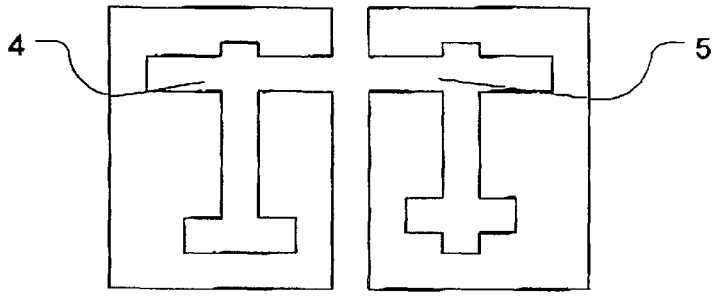
Figure 6E:
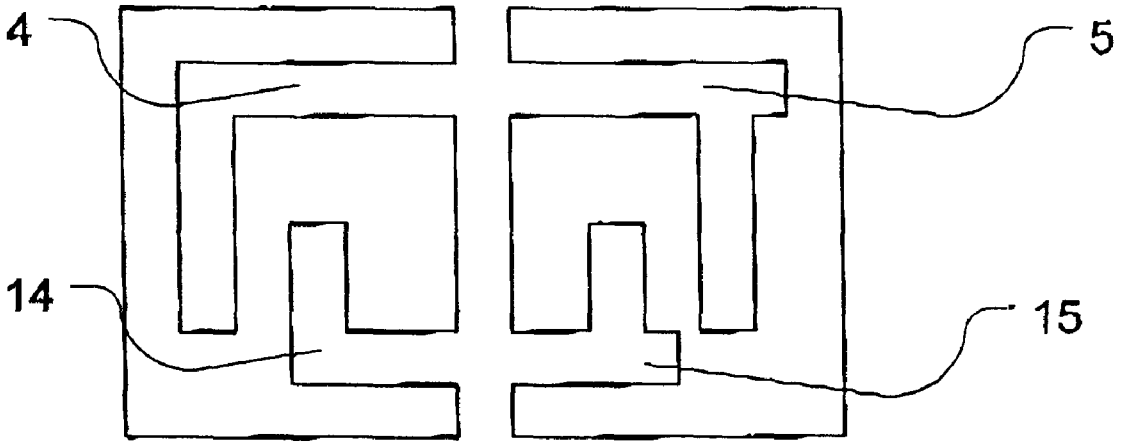
Figure 6F:
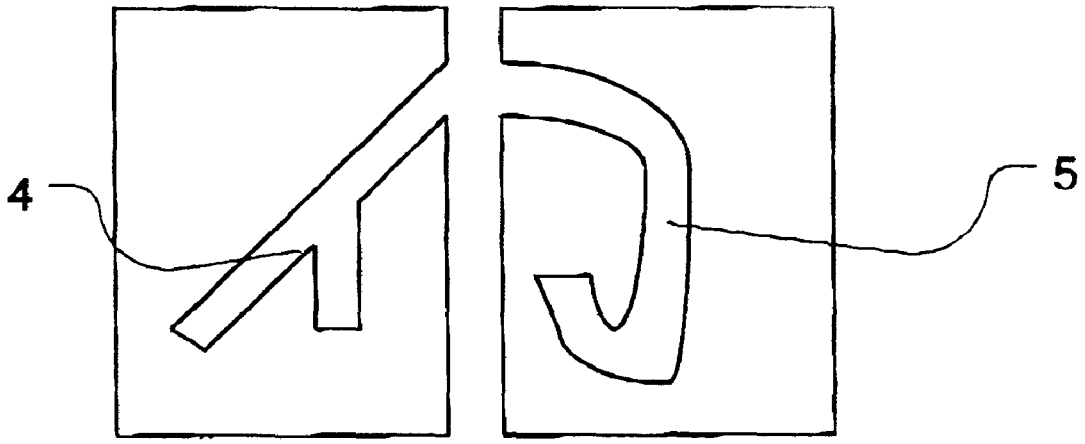

The first of the antenna 1 containing the second slot 5 resonates in a similar manner but at slightly higher frequencies. Consequently, the antenna 1 is resonant at four frequencies. However, the differences between the respective lower and upper resonant frequencies are such that the antenna 1 has two operational, unbroken 6 db bandwidths as shown In FIG. 5. In the present example, with the antenna 1 in free space, it has a lower band centered on 948 MHz with a bandwidth of 155 MHz and an upper band centered on 2038 MHz with a and with of 509 MHz. Thus, the antenna 1 provides a single structure that can be used for GSM900, DCS1SOO, DCS 1900 and WCDMA frequency bands. Furthermore, it is far smaller with a volume of 5 $cm^3$ than an equivalent using conventional planar inverted-F antennas which would require a volume of 10 $cm^3$.

The side of the antenna 1 containing the second slot 5 resonates in a similar manner but at slightly higher frequencies. Consequently, the antenna 1 is resonant at four frequencies. However, the differences between the respective lower and upper resonant frequencies are such that the antenna 1 has two operational, unbroken 6 db bandwidths as shown in FIG. 5. In the present example, with the antenna 1 in free space, it has a lower band centred on 948 MHz with a bandwidth of 155 MHz and an upper band centred on 2038 MHz with a bandwidth of 509 MHz. Thus, the antenna 1 provides a single structure that can be used for GSM900, DCS1800, DCS1900 and WCDMA frequency bands. Furthermore, it is far smaller with a volume of 5 $cm^3$ than an equivalent using conventional planar inverted-F antennas which would require a volume of 10 $cm^3$.

The present invention is not restricted to the slot forms shown in FIGS. 1 to 3.

Referring to FIG. 6(*a*), the first slot 4 is L-shaped and the second slot 5 has an angular J shape with its shank extending perpendicularly from the central strip 6.

Referring to FIG. 6(*b*), the first slot 4 is T-shaped, with its cross-piece extending perpendicularly from the central strip 6, and the second slot 5 has an angular J shape with its shank extending perpendicularly from the central strip 6 and a stub extending its shank. The openings of the two slots 4, 5 into the central strip are offset a short way with respect to each other.

Referring to FIG. 6(*c*), the first slot 4 comprises a first portion perpendicular to the central strip 6 and a T-shaped branch and the second slot 5 has a squared Z-shape.

Referring to FIG. 6(*d*), the first slot 4 comprises a straight portion perpendicular to the central strip 6 and a T-shaped portion crossing the straight portion, and the second slot 5 comprises a straight portion perpendicular to the central strip 6 and a long cross shape crossing the straight portion.

Referring to FIG. 6(*e*), the first slot 4 is L-shaped and accompanied by a third slot 14 which is also L-shaped but oppositely arranged. The second slot 5 is L-shaped with a small stub at its heel and accompanied by a fourth slot 15 which is T-shaped with its cross piece connected to the central strip 6 and it leg extending towards the second slot 4.

Referring to FIG. 6(*f*), the first slot 4 is straight and extends diagonally from the central strip and has a short branch parallel to the central strip 6. The second slot 5 is curved and generally C-shaped.

It will be appreciated that many modifications may be made to the preferred embodiment described above. For instance, one half of the antenna can be dispensed with if a less broad bandwidth is required. Alternatively, the antenna could be made symmetrical to give a reduced bandwidth but better matching characteristics.

What is claimed is:

1. A multiband antenna, comprising:

a first doubly resonant slotted substantially planar element having a first slot therein, wherein said first element is slotted such that said element has a resonance mode at a first frequency and a resonance mode at a second frequency; and a second doubly resonant slotted substantially planar element having a second slot with an open end therein, wherein said second element Is slotted such that said second element has a resonance mode at a third frequency and a resonance mode at a fourth frequency; and a common feed circuit comprising an elongate signal line extending past the open end of said slots.

2. An antenna according to claim 1, wherein the first and third frequencies are sufficiently close to provide a single unbroken usable bandwidth.

3. An antenna according to claim 2, wherein the first and second frequencies do not have a numerical ratio of 1:3.

4. An antenna according to claim 3, wherein the third and fourth frequencies do not have numerical ratio of 1:3.

5. An antenna according to claim 2, wherein the third and fourth frequencies do not have numerical ratio of 1:3.

6. An antenna according to claim 1, wherein the second and fourth frequencies are sufficiently dose to provide a single unbroken usable bandwidth.

7. An antenna according to claim 6, wherein the first and second frequencies do not have a numerical ratio of 1:3.

8. An antenna according to claim 7, wherein the third and fourth frequencies do not have numerical ratio of 1:3.

9. An antenna according to claim 6, wherein the third and fourth frequencies do not have numerical ratio of 1:3.

10. An antenna according to claim 1, wherein the first and second frequencies do not have a numerical ratio of 1:3.

11. An antenna according to claim 10, wherein the third and fourth frequencies do not have numerical ratio of 1:3.

12. An antenna according to claim 1, wherein the third and fourth frequencies do not have numerical ratio of 1:3.

13. An antenna according to claim 1, including a ground connection to said doubly resonant planar elements.

14. An antenna according to claim 1, wherein the first and second doubly resonant planar elements are formed from a unitary structure.

15. An antenna according to claim 14, wherein said unitary structure is a printed circuit board.

16. An antenna according to claim 1, wherein said planar elements are separated by a nonconductive strip into which said slots open.

17. An antenna according to claim 16, wherein the elongate signal line has an elongate axis and the non-conductive strip has a elongate axis, wherein the respective axes are aligned.

18. An antenna according to claim 1, wherein the open end of said slots are opposite one another.

19. An antenna according to claim 1, wherein the first and second doubly resonant elements are on a same plane.

20. An antenna according to claim 1, wherein the elongate signal line is on a plane substantially parallel to a plane of the first and second doubly resonant elements.

21. An antenna according to claim 1, comprising an insulating structure having two sides, wherein the signal line is on one side of the substrate and the planar elements are on another side of the substrate.

22. An antenna according to claim 1, wherein said signal line is a conductive strip.

23. A multiband antenna comprising:

a first doubly resonant slotted substantially planar element having a first slot with an open end therein, wherein said first element is slotted such that said element has a resonance mode at a first frequency and said slot has a resonance mode at a second frequency; and a second doubly resonant slotted substantially planar element having a second slot with an open end therein, wherein said second element is slotted such that said second element has a resonance mode at a third frequency and said slot of the second element has a resonance mode at a fourth frequency; and a common feed circuit comprising an elongate signal line extending past the open end of said slots.

24. The antenna according to claim 23, wherein the first and third frequencies are sufficiently close to provide a single unbroken usable bandwidth.

25. The antenna according to claim 24, wherein the first and second frequencies do not have a numerical ratio of 1:3.

26. The antenna according to claim 25, wherein the third and fourth frequencies do not have a numerical ratio of 1:3.

27. The antenna according to claim 24, wherein the third and fourth frequencies do not have a numerical ratio of 1:3.

28. The antenna according to claim 23, wherein the second and fourth frequencies are sufficiently close to provide a single unbroken usable bandwidth.

29. The antenna according to claim 28, wherein the first and second frequencies do not have a numerical ratio of 1:3.

30. The antenna according to claim 29, wherein the third and fourth frequencies do not have a numerical ratio of 1:3.

31. The antenna according to claim 28, wherein the third and fourth frequencies do not have a numerical ratio of 1:3.

32. The antenna according to claim 23, wherein the first and second frequencies do not have a numerical ratio of 1:3.

33. The antenna according to claim 32, wherein the third and fourth frequencies do not have a numerical ratio of 1:3.

34. The antenna according to claim 23, wherein the third and fourth frequencies do not have a numerical ratio of 1:3.

35. The antenna according to claim 23, including a ground connection to said doubly resonant planar elements.

36. The antenna according to claim 23, wherein the first and second doubly resonant planar elements are formed from a unitary structure.

37. The antenna according to claim 36, wherein said unitary structure is a printed circuit board.

38. The antenna according to claim 36, wherein said planar elements are separated by a non-conductive strip into which said slots open.

39. The antenna according to claim 38, wherein the elongate signal line has an elongate axis and the nonconductive strip has an elongate axis and the respective axes are aligned.

40. The antenna according to claim 23, wherein the open end of said slots, are opposite one another.

41. The antenna according to clam 23, wherein the first and second doubly resonant elements are on a same plane.

42. The antenna according to claim 23, wherein the elongate signal line is on a plane substantially parallel to the plane of the first and second doubly resonant elements.

43. The antenna according to claim 23, conprising an insulating substrate having two sides, wherein the signal line is on one side of the substrate and the planar elements are on another side of the substrate.

44. The antenna according to claim 23, wherein said signal line is a conductive strip.

* * * * *